US005525195A

United States Patent [19]

Friend et al.

[11] Patent Number: 5,525,195

[45] **Date of Patent: *Jun. 11, 1996**

[54] PROCESS FOR HIGH CONSISTENCY DELIGNIFICATION USING A LOW CONSISTENCY ALKALI PRETREATMENT

[75] Inventors: William H. Friend, Savannah, Ga.; Stuart T. Terrett, Elgin, S.C.; Spencer W. Eachus, Allentown, N.J.; Bruce F. Griggs, Columbia, S.C.

[73] Assignee: Union Camp Patent Holding, Inc., Wayne, N.J.

[ * ] Notice: The term of this patent shall not extend beyond the expiration date of Pat. No. 5,217,574.

[21] Appl. No.: 117,341

[22] Filed: Sep. 7, 1993

Related U.S. Application Data

[63] Continuation of Ser. No. 784,184, Oct. 29, 1991, abandoned, which is a continuation-in-part of Ser. No. 637,100, Jan. 3, 1991, Pat. No. 5,173,153, Ser. No. 686,062, Apr. 16, 1991, Pat. No. 5,217,574, and Ser. No. 489,845, Mar. 2, 1990, Pat. No. 5,085,734, which is a continuation-in-part of Ser. No. 311,669, Feb. 15, 1989, abandoned.

[51] Int. Cl.[6] ..... D21C 9/12; D21C 9/147

[52] U.S. Cl. ..... 162/40; 162/56; 162/65; 162/90

[58] Field of Search ..... 162/65, 57, 40, 162/56, 60, 89, 19, 90

[56] References Cited

U.S. PATENT DOCUMENTS

| | | | |
|---|---|---|---|
| 1,860,432 | 5/1932 | Richter . | |
| 2,926,114 | 2/1960 | Grangaard et al. | 260/212 |
| 3,024,158 | 3/1962 | Grangaard et al. | 162/17 |

(List continued on next page.)

FOREIGN PATENT DOCUMENTS

| | | |
|---|---|---|
| 1119360 | 3/1982 | Canada . |
| 1132760 | 10/1982 | Canada . |
| 1154205 | 9/1983 | Canada . |
| 0047656A1 | 3/1982 | European Pat. Off. . |
| 062539 | 10/1982 | European Pat. Off. . |
| 106460 | 4/1984 | European Pat. Off. . |
| 106609 | 4/1984 | European Pat. Off. . |
| 152865 | 8/1971 | New Zealand . |
| 162258 | 5/1972 | New Zealand . |
| 162119 | 7/1972 | New Zealand . |
| 158591 | 11/1972 | New Zealand . |
| 169558 | 4/1974 | New Zealand . |
| 167756 | 4/1974 | New Zealand . |
| 175906 | 7/1977 | New Zealand . |
| 192009 | 3/1982 | New Zealand . |
| 194036 | 11/1983 | New Zealand . |

OTHER PUBLICATIONS

Abrahamsson et al., "Oxygen/Sodium Carbonate Bleaching of Kraft Pulp Pretreated with Nitrogen Dioxide and Oxygen", Svensk Papperstidning (1983).

Allison, "Production of Bleached Softwood Pulp by Low Pollution Processes", Wood Sci. Technol. 17, pp. 129–137 (1983).

(List continued on next page.)

*Primary Examiner*—Steven Alvo

*Attorney, Agent, or Firm*—Nath & Associates; Gary M. Nath; Suet M. Chong

[57] ABSTRACT

Unbleached pulp is washed with an aqueous alkaline solution in a wash press to substantially uniformly distribute a first amount of alkaline material throughout the pulp. The consistency of the pulp exiting the wash press is above about 18%, preferably between 25 to 35 percent by weight, and the high consistency alkali containing pulp is then treated with oxygen to effect delignification. The use of a wash press reduces the overall amounts of alkaline material utilized in the process compared to processes which add alkaline material to the pulp at low consistency. Additional alkali may be applied, if desired, onto the high consistency pulp prior to oxygen delignification to provide a total amount of between 0.8 and 7 percent by weight of oven dry pulp. High strength, low lignin pulps are formed after oxygen delignification which may be further bleached to high brightness with reduced amounts of bleaching chemicals.

21 Claims, 4 Drawing Sheets

U.S. PATENT DOCUMENTS

| | | | |
|---|---|---|---|
| 3,251,730 | 5/1966 | Watanabe | 162/56 |
| 3,274,049 | 9/1966 | Gaschke et al. | 162/65 |
| 3,384,533 | 5/1968 | Meylan et al. | 162/65 |
| 3,423,282 | 1/1969 | Rerolle et al. | 162/65 |
| 3,652,388 | 3/1972 | Croon et al. | 162/65 |
| 3,660,225 | 6/1972 | Verreyne et al. | 162/17 |
| 3,661,699 | 5/1972 | Farley | 162/65 |
| 3,740,310 | 6/1973 | Smith et al. | 162/65 |
| 3,759,783 | 9/1973 | Samuelson et al. | 162/40 |
| 3,832,276 | 8/1974 | Roymoulik et al. | 162/65 |
| 3,874,992 | 4/1975 | Liebergott | 162/66 |
| 3,888,727 | 6/1975 | Kenig | 162/65 |
| 3,951,733 | 5/1976 | Phillips | 162/65 |
| 4,080,249 | 3/1978 | Kempf et al. | 162/57 |
| 4,089,737 | 5/1978 | Nagano et al. | 162/19 |
| 4,120,747 | 10/1978 | Sarge, III et al. | 162/117 |
| 4,155,806 | 5/1979 | Mannbro | 162/19 |
| 4,198,266 | 4/1980 | Kirk et al. | 162/29 |
| 4,220,498 | 9/1980 | Prough | 162/25 |
| 4,248,662 | 2/1981 | Wallick | 162/19 |
| 4,259,150 | 3/1981 | Prough | 162/40 |
| 4,274,913 | 6/1981 | Kikuiri et al. | 162/65 |
| 4,295,925 | 10/1981 | Bentvelzen et al. | 162/19 |
| 4,295,926 | 10/1981 | Bentvelzen et al. | 162/57 |
| 4,298,426 | 11/1981 | Torregrossa et al. | 162/57 |
| 4,298,427 | 11/1981 | Bentvelzen et al. | 162/57 |
| 4,363,697 | 12/1982 | Markham et al. | 162/19 |
| 4,372,812 | 2/1983 | Phillips | 162/40 |
| 4,384,920 | 5/1983 | Markham et al. | 162/19 |
| 4,431,480 | 2/1984 | Markham et al. | 162/19 |
| 4,435,249 | 2/1984 | Markham et al. | 162/24 |
| 4,439,271 | 3/1984 | Samuelson | 162/19 |
| 4,450,044 | 5/1984 | Fritzvold et al. | 162/65 |
| 4,451,332 | 5/1984 | Annergren et al. | 162/30.1 |
| 4,459,174 | 7/1984 | Papageorges et al. | 162/40 |
| 4,568,420 | 2/1986 | Nonni | 162/65 |
| 4,595,455 | 6/1986 | Mannbro | 162/38 |
| 4,619,733 | 10/1986 | Kooi | 162/30.1 |
| 4,806,203 | 4/1989 | Elton | 162/19 |
| 4,834,837 | 5/1989 | Loquenz | 162/56 |
| 4,840,703 | 6/1989 | Malmsten | 162/49 |
| 5,085,734 | 2/1992 | Griggs | 162/57 |
| 5,173,153 | 12/1992 | Terrett et al. | 162/57 |

OTHER PUBLICATIONS

Andtbaka, "Low Kappa Pulping Followed by Oxygen Delignification", Appita, vol. 39, No. 2, (1986), pp. 154–172.

Brannland et al., "How to Cope With TOCL", International Oxygen Delignification Conference, (1987).

Carlberg et al., "Bleaching of Sulphite and Sulphate Pulps Using Conventional and Unconventional Sequences", TAPPI Proceedings 1982 Annual Meeting, p. 381.

Casey, J. P., "Bleaching: A Perspective", *TAPPI Journal*, vol. 66, No. 7 (Jul. 1983) p. 95.

Christensen, P. K., "Bleaching of Sulphate Pulps With Hydrogen Peroxide".

DeSousa et al., "The Influence of Chlorine Ratio and Oxygen Bleaching on the Formation of PCDF's and PCCD's in Pulp Bleaching", *TAPPI Journal* (Apr. 1989).

Elton et al., "New Technology for Medium–Consistency Oxygen Bleaching".

Fossum et al., "Final Bleaching of Kraft Pulps Delignified to Low Kappa Number by Oxygen Bleaching", Tappi Journal pp. 60–62 (Dec. 1983).

Fujii, et al., "Oxygen Pulping of Hardwoods," TAPPI, Alkaline Pulping/Secondary Fibers Conference (Washington, D.C., Nov. 7–10, 1977).

Gellerstedt et al., "Singlet Oxygen Oxidation of Lignin Structures," *Singlet Oxygen*, Chapter 31, pp. 302–310, (Sept. 1976).

Germgard et al., "Mathematical Models for Simulation and Control of Bleaching Stages", Nordic Pulp and Paper Research Journal, No. 1 (1987).

Gierer, "Chemistry of Delignification, Part 2: Reactions of Lignins During Bleaching", Word Science and Technology (1986).

Gierer, "Mechanisms of Bleach with Oxygen–Containing Species", ISWPC, (1987).

Gupta, et al., "OZ Prebleaching, Influence of Viscosity and Sheet Strength", TAPPI Symposium—Oxygen Delignification, p. 1 (1984).

Heimburger et al., "Kraft Mill Bleach Plant Effluents: Recent Developments Aimed at Decreasing Their Environmental Impact".

Heimburger et al., "Kraft Mill Bleach Plant Effluents: Recent Developments Aimed at Decreasing Their Environmental Impact Part II", TAPPI Journal, p. 69 (Nov. 1988).

Jamieson et al., "Integration of Oxygen Bleaching in the Brown Stock Washing Sytem", Svensk Paperstidning (1973).

Kirk et al., "Low Consistency Oxygen Delignification in a Pipeline Reactor", TAPPI, vol. 61, No. 5.

Leopold, B., "The Pulping Mill of the Future", *Textile and Paper Chemistry and Technology*, p.239.

Leopold, B., "The Pulping Process—Opportunity or Headache?" Proceedings of IPC Conference, Paper Science and Technology, May 8–10, 1979.

Liebergott, et al., "The Use of Ozone in Bleaching and Brightening Wood Pulps: Part I–Chemical Pulps" (TAPPI 1978).

Liebergott et al., "The Use of Ozone or Oxygen in the First Bleaching State", *Ozone: Science and Engineering*, vol. 4, p. 109 (1982).

Liebergott, et al., "Bleaching a Softwood Kraft Pulp Without Chlorine Compounds", TAPPI Journal, p. 76 (Aug. 1984).

Liebergott et al., "Bleaching a Softwood Kraft Pulp Without Chlorine Compounds", pp. 1–10.

Liebergott, et al., "Comparison Between Oxygen and Ozone Delignification in the Bleaching of Kraft Pulps", TAPPI Proceedings–1981 Pulping Conference, p. 157.

McDonough, "Oxygen Bleaching's Pace Quickens", IPC Technical Paper Series, No. 246 (Jul. 1987).

Perkins et al, "Brown Stock Washing Efficiency", *TAPPI*, vol. 37, No. 3, Mar. 1954, pp. 83–89.

Rydholm, "Pulping Processes", Interscience Publishers, New York, 1967, pp. 880–883.

Ohnishi, K., "Japan: Pulping, Bleaching", *Pulp and Paper* (Aug. 1978) p. 88.

Ow, et al., "Advances In Ozone Bleaching: Part II—Bleaching of Softwood Kraft Pulps With Oxygen and Ozone Combination", TAPPI Symposium–Oxygen Delignification (1984).

Partridge, H., "New Pulp Bleaching Developments", *CEP* (Jun. 1976).

Partridge, H., "An Overview of New Pulp Bleaching Developments" AIChE National Meeting, Paper No. 24a. (Sep. 7–10, 1975).

Perkins et al., "Advances in Ozone Bleaching—Part III—Pilot Plant Installations and Proposed Commercial Implementation".

Seifert et al., "Engineering Considerations in the Design of Oxygen Reactors", p. 309.

Singh, "The Bleaching of Pulp", TAPPI, 3rd ed., Chapter 7 (1979).

Smook, "Bleaching, Handbook For Pulp & Paper Technologies" – Chapter 11 (TAPPI).

Soteland, N., "Bleaching of Chemical Pulps With Oxygen and Ozone", Pulp and Paper Magazine of Canada, vol. 75, No. 4 (Apr., 1974) p. 91.

Soteland, N., "Bleaching of Chemical Pulps With Oxygen and Ozone", *Norsk Skogindustri* (Sep. 1978) p. 199.

Soteland, "Comparison Between Oxygen and Ozone Delignification of Sulphite Pulps", TAPPI Symposium—Oxygen Delignification p. 71 (1984).

Wong et al., "Toxicity, BOD and Color of Effluents From Novel Bleaching Processes", *Pulp and Paper Magazine of Canada*, vol. 79, No. 7 (Jul. 1978) p. 41.

PROCESS FOR HIGH CONSISTENCY DELIGNIFICATION USING A LOW CONSISTENCY ALKALI PRETREATMENT

CROSS-REFERENCE TO RELATED APPLICATIONS

This application is a Continuation of Ser. No. 07/784,184, filed Oct. 29, 1991, now abandoned; which is (1) a continuation-in-part of application Ser. No. 07/637,100 filed Jan. 3, 1991, now U.S. Pat. No. 5,173,153, (2) and a continuation-in-part of application Ser. No. 07/686,062 filed Apr. 16, 1991, now U.S. Pat. No. 5,217,574, and (3) a continuation-in-part of application Ser. No. 07/489,845 filed Mar. 2, 1990, now U.S. Pat. No. 5,085,734, which is a continuation-in-part of application Ser. No. 07/311,669 filed Feb. 15, 1989, now abandoned.

FIELD OF INVENTION

The present invention relates to a method for the treatment of wood pulp, and more particularly to a method for distributing alkaline material upon brownstock pulp prior to oxygen delignification so that a highly delignified pulp can be obtained after oxygen delignification without deleteriously affecting the strength of the pulp.

BACKGROUND OF THE INVENTION

Wood is comprised in major proportion of cellulose and hemicellulose fiber and amorphous, non-fibrous lignin which serves to hold the fibrous portions together. The hemicellulose and the cellulose are sometimes referred to collectively as holocellulose. During the treatment of wood to produce pulp, the wood is transformed into a fibrous mass by removing a substantial portion of the lignin from the wood. Thus, processes for the production of paper and paper products generally include a pulping stage in which wood, usually in the form of wood chips, is reduced to a fibrous mass. Several different pulping methods are known in the art; they are generally classified as mechanical, chemical or semi-chemical pulping.

Chemical pulping methods include a wide variety of processes, such as the sulfite process, the bisulfite process, the soda process and the Kraft process. The Kraft process is the predominant form of chemical pulping.

Chemical pulping operations generally comprise introducing wood chips into a digesting vessel where they are cooked in a chemical liquor. In the Kraft process, the cooking liquor comprises a mixture of sodium hydroxide and sodium sulfide. After the required cooking period, softened and delignified wood chips are separated from the cooking liquor to produce a fibrous mass of pulp. The pulp produced by chemical pulping is called "brownstock." The brownstock is typically washed to remove cooking liquor and then processed for the production of unbleached grades of paper products or, alternatively, bleached for the production of high brightness paper products.

Since chromophoric groups on the lignin are principally responsible for color in the pulp, most methods for the bleaching of brownstock require further delignification of the brownstock. For example, the brownstock may be reacted with elemental chlorine in an acidic medium or with hypochlorite in an alkaline solution to effect this further delignification. These steps are typically followed by reactions with chlorine dioxide to produce a fully bleached product. Oxygen delignification is a method that has been used at an increasing rate in recent years for the bleaching of pulp because it uses inexpensive bleach chemicals and produces by-products which can be burned in a recovery boiler reducing environmental pollutants. Oxygen delignification is frequently followed by bleach stages which use chlorine or chlorine dioxide but require less bleach chemical and produce less environmental pollutants because of the bleaching achieved in the oxygen stage.

In some bleaching processes, the pulp is bleached while being maintained at low to medium levels of pulp consistency. Pulp consistency is a measure of the percentage of solid fibrous material in pulp. Pulps having a consistency of less than about 10% by weight are said to be in the low to medium range of pulp consistency. Processes which require bleaching at low to medium consistency are described in the following patents and publications: U.S. Pat. No. 4,198,266, issued to Kirk et al; U.S. Pat. No. 4,431,480, issued to Markham et al; U.S. Pat. No. 4,220,498, issued to Prough; and an article by Kirk et al. entitled "Low-consistency Oxygen Delignification in a Pipeline Reactor—A Pilot Study", TAPPI, May 1978. Each of the foregoing describe an oxygen delignification step that operates upon pulps in the low to medium consistency range.

U.S. Pat. No. 4,806,203, issued to Elton, discloses an alkaline extraction, preferably for chlorinated pulp, wherein the timed removal of alkaline solution is essential to prevent redepositing of dissolved lignin back onto the pulp. If too short or too long of a time period passes in this stage, the process shows little benefit.

Oxygen delignification of wood pulp can be carried out on fluffed, high consistency pulp in a pressurized reactor. The consistency of the pulp is typically maintained between about 20% and 30% by weight during the oxygen delignification step. Gaseous oxygen at pressures of from about 80 to about 100 psig is introduced into and reacted with the high consistency pulp. See, G. A. Smook, *Handbook for Pulp and Paper Technologists,* Chapter 11.4 (1982). In previous oxygen delignification operations, the pulp after cooking is washed and dewatered to produce a high consistency mat. The pulp mat is then covered with a thin film or layer of an alkaline solution, by spraying the solution onto the surface of the mat. The amount of alkaline solution sprayed onto the mat is about 0.8 to 7% by weight of oven dry pulp.

Previously used high consistency oxygen delignification processes have several disadvantages. In particular, it has now been found that spraying an alkaline solution onto a mat of high consistency pulp does not provide an even distribution of solution throughout the fibrous mass, notwithstanding the generally porous nature of such mats. As a result of this uneven distribution, certain areas of the high consistency mat, usually the outer portions, are exposed to excessive amounts of the alkaline solution. This excessive exposure is believed to cause nonselective degradation of the holocellulosic materials resulting in a relatively weak pulp, at least locally. On the other hand, other portions of the high consistency mat, typically the inner portions, may not be sufficiently exposed to the alkaline solution to achieve the desired degree of delignification. Thus, overall quality declines.

SUMMARY OF THE INVENTION

The present invention provides a novel process for obtaining enhanced delignification selectivity of a pulp during a high consistency oxygen delignification process wherein the oxygen delignified pulp has greater strength and a lower lignin content than has been attainable by prior art processes. In addition, a wash press is utilized to apply a desired quantity of alkaline material onto the pulp while also reducing the amount of solids on the pulp which enters the oxygen delignification reactor.

In accordance with the present invention, a first amount of alkaline material is applied to an unbleached pulp by washing the pulp in a wash press with a solution of an alkaline material to a consistency of at least about 18 percent by weight to substantially uniformly distribute the first amount of alkaline material throughout the pulp. This uniform distribution of the first amount of alkaline material is sufficient to assist in the enhancement of delignification selectivity during high consistency oxygen delignification compared to processes where the alkaline material is applied upon high consistency pulp or is applied at relatively low amounts onto low consistency pulp.

In one embodiment of the invention, the pulp is brownstock which is washed with a sufficient amount of alkaline material so that the first amount applied to the pulp equals the total amount. The pulp may be mixed with dilution water to obtain a low consistency pulp having a consistency of less than about 5 percent by weight and preferably between about 1 and 4.5 percent by weight before being directed into the wash press. The wash press increases the consistency of the pulp to a high consistency, and removes pressate. At least a portion of this pressate can be used as the dilution water.

The pressate may contain alkaline material and, if so, a portion may be used to wash the pulp prior to directing the pulp to the wash press. Ideally, the wash press is operated at a dilution factor at or near zero and at a displacement ratio of as close to 1 as possible to minimize the total alkali required. These values are difficult to achieve and maintain in commercial operation, however, so that the wash press should be operated at a dilution factor of 0.4 or less, preferably less than 0.25 and at a displacement ratio of at least about 0.5 and preferably above about 0.75.

In a second embodiment, a split alkaline material addition sequence is used to apply the total amount of alkaline material to the pulp. The first amount of alkaline material is applied to the pulp in the wash press while a second amount is applied to the high consistency pulp. This reduces the amount of alkaline material utilized in the wash press.

For either embodiment, a predetermined quantity of pressate may be retained in a holding tank. This quantity of pressate may be continuously returned or recycled directly to the pulp/dilution water mixing step. The total amount of alkaline material applied to the pulp is generally between about 0.8 and 7 percent by weight based on oven dry pulp, and the pulp is then subjected to oxygen delignification whereby enhanced delignification is achieved.

DESCRIPTION OF PREFERRED EMBODIMENTS

The present invention relates to a process for treating brownstock pulp with alkaline material prior to high consistency oxygen delignification wherein the pulp is substantially uniformly treated with the alkaline material in a manner which minimizes usage of alkaline material and solids buildup on the pulp.

In U.S. Pat. No. 5,085,734, it was demonstrated that delignification selectivity across a high consistency oxygen stage could be increased by substantially uniformly distributing alkaline material throughout the pulp. This distribution is achieved by mixing a solution of alkaline material with low consistency pulp prior to pressing the pulp to high consistency. Thus, a reduction in K No. in the pulp across the oxygen stage of greater than 50% and generally at least 60% or more can be achieved with essentially no damage to the cellulose portion of the pulp.

Figure 1:
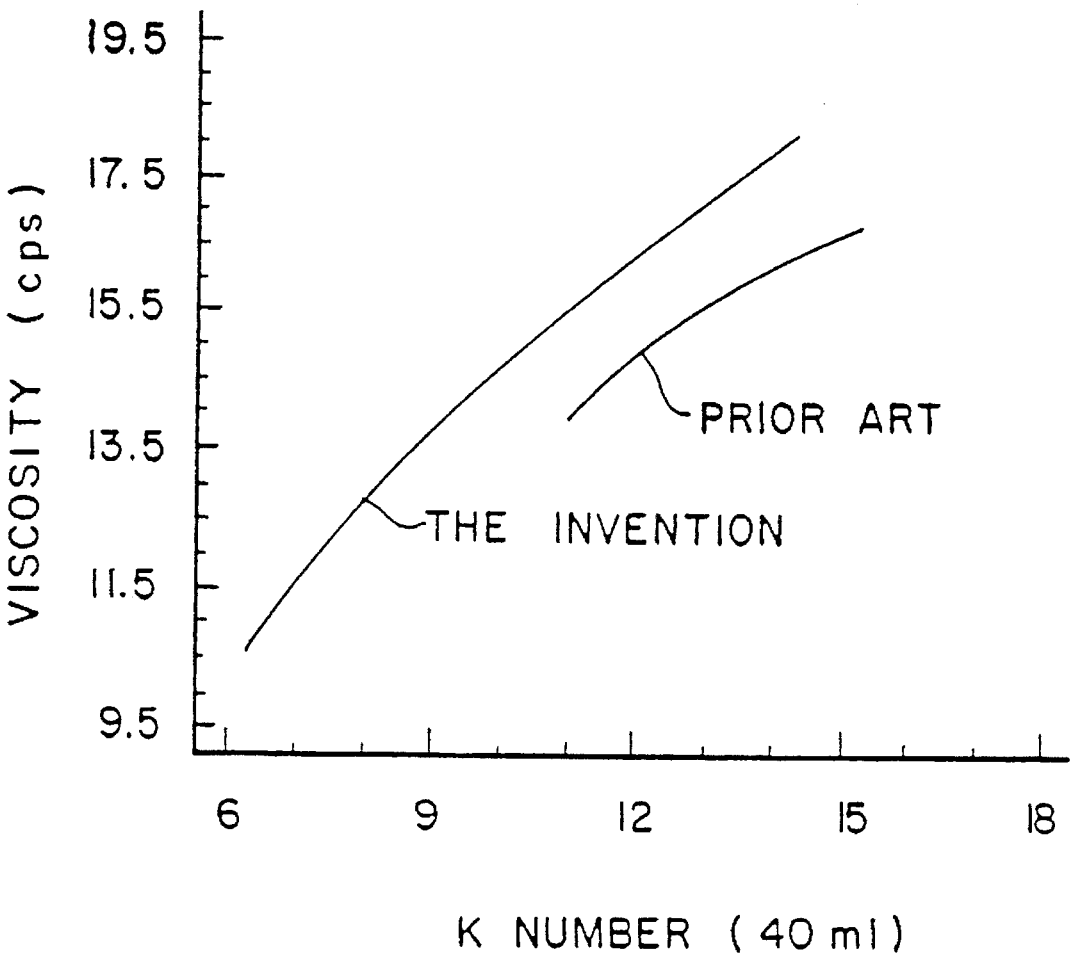
FIG. 1 is a graph showing the relationship between pulp viscosity and K No. for softwood pulps treated with alkaline material and delignified with oxygen according to the present invention compared to those representative of the prior art.

The examples of the patent demonstrate the unexpected degree of improvement in delignification selectivity compared to spraying the alkaline material onto a pad of high consistency pulp after it emerges from a press or other thickening device. This is shown by the reduction in pulp K No. from about 10 to 26 upon entering the oxygen reactor (depending upon the type of wood and the type of pulping conducted upon the particular wood) to between about 5 and 10 after oxygen delignification with a change in viscosity of the pulp from about 19 cps or more for the incoming pulp to at least about 13 cps for the oxygen delignified pulp. For softwood pulp, this data is summarized and illustrated in the graph of FIG. 1.

While this patented technique is successful, it requires the use of greater amounts of alkaline material compared to the spray applied process, because much of the alkaline material is retained in the pressate. The process of the present invention achieves similar results in the uniform distribution of alkaline material throughout the pulp by utilizing a wash press to introduce the alkaline material onto the pulp, while utilizing less alkaline material than the patented alkaline material distribution process. Furthermore, since the same amounts of alkaline material are substantially uniformly distributed throughout the pulp, the same advantages with regard to increased delignification selectivity across the subsequent oxygen delignification stage would be achieved.

A wash press typically includes two synchronous, counter-rotating, dewatering rolls configured and designed to provide a dewatering section, a wash section and a final extraction section. Pulp enters the press at a low consistency of about 3.5 percent by weight in solution with dilution water. In the initial dewatering section, the consistency is increased to about 10 percent by weight and a pad is formed on the rolls. In the wash section, wash water is introduced onto the free side of the pad and begins to be forced to pass therethrough, displacing the dilution water in the pad. In the extraction (or consolidation) section, additional dilution and wash water is displaced from the pad to raise the consistency of the pulp. The pulp then exits the press at a high consistency of between about 25 and 35 percent by weight.

To understand the present invention, one must be familiar with the terms and conditions relating to pulp washing. The term "dilution water" is used to refer to the water associated with the pulp as it enters the press.

The term "wash water" is used to mean the water that is added to the press independent of the pulp.

The term "dilution factor" is used to mean the amount of wash water which is added to the wash press in excess of that required to replace the amount of water which exits with the pulp at the wash press outlet consistency. For an amount of wash water which is needed only to replace only that amount which leaves with the pulp, the dilution factor ("DF") would be zero. This factor is expressed as pounds of water per pound of air dry ("AD") fiber (note: 1 pound AD fiber equals 0.9 pound oven dry ("OD") fiber). The dilution factor can be calculated from the following formula:

$$DF = WT - \left[ \frac{0.9 \text{ lb. } OD \text{ fiber}}{\text{lb. } AD \text{ fiber}} \times \left( \frac{100 - C}{C} \right) \right]$$

where

WT is the amount of wash water utilized (in pounds per pound of air dry fiber; and C is the consistency of the pulp exiting the wash press.

For example, for a DF of zero and 28% consistency pulp, the amount of wash water necessary to replace that which leaves with the pulp is calculated as follows:

$$0 = WT - \left[ 0.9 \times \left( \frac{1 - .28}{.28} \right) \right]$$

WT=2.31 pounds of water per pound of air dry fiber

An amount of water greater than this 2.31 value provides an excess which leaves the wash press as pressate.

The term "displacement ratio" is used to mean a fraction representing the actual change in concentration of a dissolved component in the dilution water associated with the pulp exiting the wash press divided by the maximum possible change, i.e., the concentration of the component in the wash water less the concentration of the same component in the dilution water. The displacement ratio ("DR") can be calculated from the following equation:

$$DR=(X_{OUT}-X_{IN})/(X_W-X_{IN})$$

where $X_{OUT}$ is the concentration of a particular component in the dilution water leaving with the pulp;

$X_{IN}$ is the concentration of the same component in the dilution water entering the wash press; and $X_W$ is the concentration of the same component in the wash water.

It is readily observed that, when $X_{OUT}=X_W$, the displacement ratio is 1, while for displacement ratio of less than 1, $$X_{OUT}=(DR)(X_W)+(1-DR)(X_{IN})$$

For example, if DR=0.75:

$$X_{OUT}=0.75(X_W)+0.25(X_{IN})$$

while for a DR of 0.5:

$$X_{OUT}=0.5(X_W)+0.5(X_{IN})$$

These washing concepts usually apply to the removal of an unwanted component, such as black liquor solids, from the pulp where the concentration of the component in the wash water is substantially less than in the dilution water. In the present invention, however, these relationships are utilized to illustrate how the concentration of a component in the wash (such as alkaline material) water can be made higher than its concentration in the dilution water so that the component can be added to, rather than removed from, the pulp.

As is evident from the formulae presented above, with a dilution factor of zero and a displacement ratio of 1, all alkaline material added to the wash water (at a concentration of $X_W$) will theoretically be retained upon the pulp as it exits the wash press. While it is not possible to commercially operate the wash press to achieve complete displacement and substitution of the wash water for the dilution water contained in the pulp, the process should be operated at dilution factors of below about 0.4 and at displacement ratios above 0.5. This provides three advantages for the process of the present invention.

1) very little alkaline material is lost from the wash press into the pressate;

2) rapid responses to pulp changes can be achieved by changing the concentration of alkaline material in the wash water ($X_W$); and 3) sufficient washing of the pulp occurs in the press so that the carryover of dissolved black liquor or other contaminants into the oxygen reactor is significantly reduced.

Another advantage of this embodiment of the present process is that the control strategy and equipment for the introduction of alkaline material is simplified, in that only one addition point is required.

The present invention therefore provides high quality, high strength, delignified wood pulp from Kraft pulp or pulps produced by other chemical pulping processes. The preferred starting material is unbleached pulp obtained by cooking wood chips or other fibrous materials in a cooking liquor, such as by the Kraft or Kraft AQ process.

Figure 2:
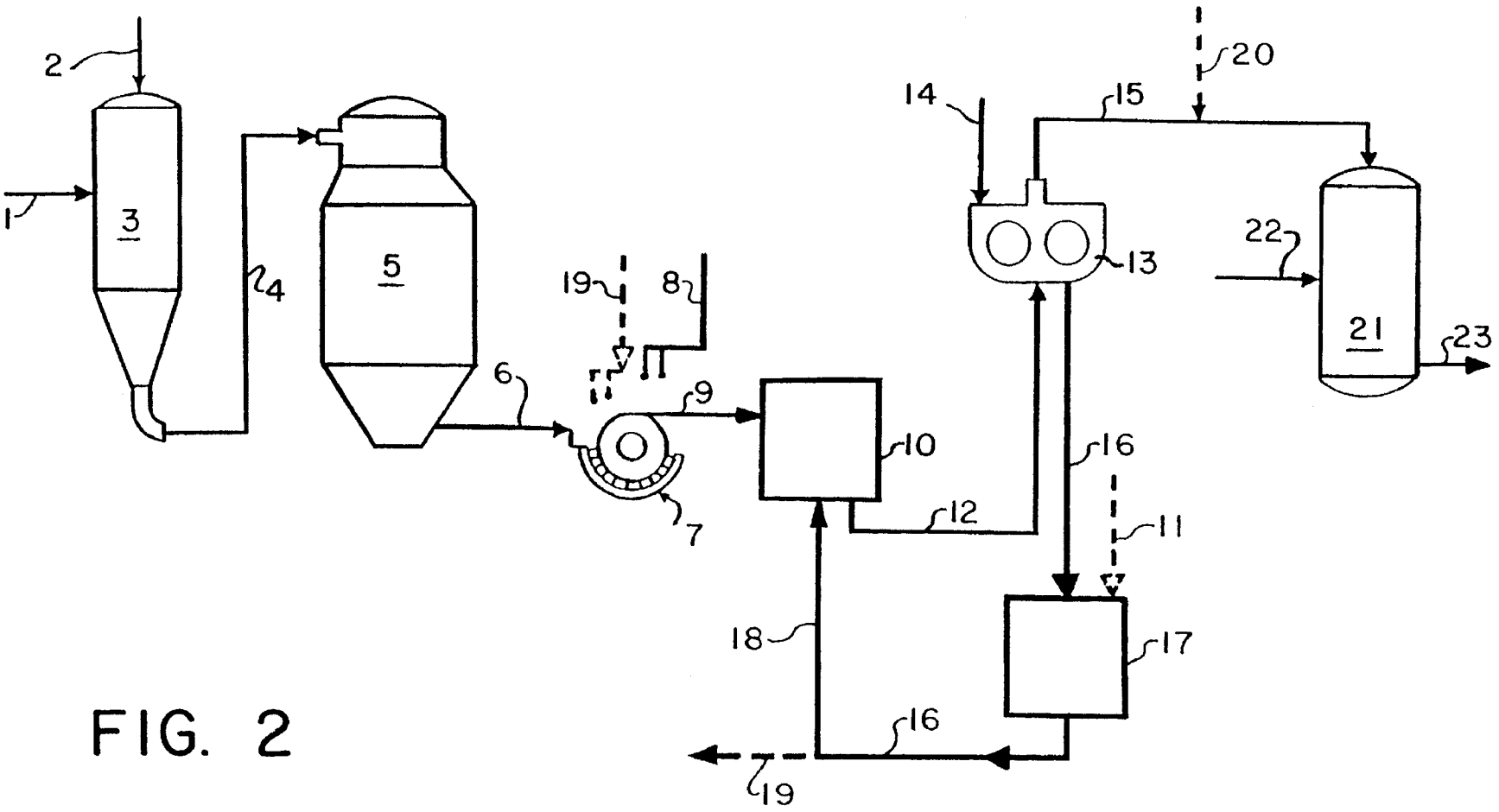
FIG. 2 is a schematic representation of the process of the present invention.

With reference to FIG. 2, wood chips 1 and a white liquor 2 comprising sodium hydroxide and sodium sulfide are introduced into a digester 3. Sufficient white liquor should be introduced into the digester to substantially cover the wood chips. The contents of the digester are then heated at a temperature and for a time sufficient to allow the white liquor to substantially impregnate the wood chips and substantially complete the cooking reaction.

This wood chip cooking step is conventionally known as Kraft cooking or the Kraft process and the pulp produced by this process is known as Kraft pulp or Kraft brownstock. Depending upon the lignocellulosic starting material, the delignification results obtained with the conventional Kraft process may be increased by the use of extended delignification techniques or the Kraft-AQ process. Moreover, these techniques are preferred for obtaining the greatest degree of reduction in K No. of the pulp without deleteriously affecting the strength and viscosity properties of the pulp during the cooking stage.

When using the Kraft-AQ technique, the amount of anthraquinone in the cooking liquor should be an amount of at least about 0.01% by weight, based on the oven dried weight of the wood to be pulped, with amounts of from 0.02 to about 0.1% generally being preferred. The inclusion of anthraquinone in the Kraft pulping process contributes significantly to the removal of the lignin without adversely affecting the desired strength characteristics of the remaining cellulose. Also, the additional cost for the anthraquinone is partially offset by the savings in cost of chemicals utilized in the bleaching steps which follow oxygen delignification of the pulp.

Alternatively or additively to Kraft-AQ is the use of techniques for extended delignification such as the Kamyr MCC, Beloit RDH and Sunds Super Batch Methods. These techniques also offer the ability to remove more of the lignin during cooking without adversely affecting the desired strength characteristics of the remaining cellulose.

The digester 3 produces a black liquor containing the reaction products of lignin solubilization together with brownstock 4. The cooking step is typically followed by washing to remove most of the dissolved organics and cooking chemicals for recycle and recovery, as well as a screening stage in which the pulp is passed through a screening apparatus to remove bundles of fibers that have not been separated in pulping. The brownstock 4 is then directed to a blow tank 5.

Brownstock 6 exiting blow tank 5 is washed in washer 7 generally with effluent 8 generated from the washing of pulp downstream of the oxygen delignification reactor. The washed pulp 9 exits the washer 7 at a consistency of about 15 to 18 percent by weight and is directed to a dilution tank 10, where it is diluted to a consistency of about 3.5 percent by weight. The dilution water on startup is supplied by filling the tank 10 with water 11. The pulp/dilution water stream 12 is then directed into wash press 13 where alkaline material is added to the pulp.

A preferred wash press 13 is Displacement Press DP, which is available from Sunds Defibrator AB, Sundsvall, Sweden. Other twin-roll presses may also be used, provided that they possess the combination of dewatering, washing and displacement of the pulp, as described above. The Sunds device includes two synchronous, counter-rotating dewatering rolls in a pressurized vat that has dual pulp inlets. A pad of pulp having a consistency of about 10 percent by weight is formed on the rolls at the end of the dewatering section.

A solution 14 of sodium hydroxide, oxidized white liquor, or other equivalent alkaline material is used to wash the pulp in the wash press 13. This solution 14 is preferably prepared by mixing concentrated alkaline material with bleached pulp wash water effluent. Then, solution 14 is introduced on the free side of the pulp pad and begins to move through the pulp pad to displace the dilution water therein. By attempting to operate at a displacement ratio of close to 1 and a dilution factor of close to zero, most of the alkaline material used to wash the pulp is substantially uniformly distributed throughout the pulp and is retained thereon. As noted above, the wash press 13 should be operated at a dilution factor of less than 0.4 and a displacement ratio of at least about 0.7 to achieve the desired distribution of alkaline material on the pulp. The alkaline material containing pulp then exits the wash press 13 at a consistency of 25 to 35 percent by weight. In a most preferred embodiment, the pulp 15 has a consistency of about 28 to 29 percent by weight.

The wash press 13 enables reduced quantities of alkaline material to be used for application of the desired amount onto the pulp compared to e.g., the use of a chest to add to alkaline material to the pulp. Also, the amounts of organic and/or inorganic solids on the pulp exiting the wash press 13 are reduced, so that less of these contaminants are carried by the pulp into the oxygen reactor. Thus, lesser amounts of chemical are consumed during the oxygen reaction with the pulp. In addition, compared to a conventional washer, less alkaline material is lost to the plant liquid recovery system due to pressate discharge or due to "breakthrough" of pressate into the washer effluent.

One skilled in the art can select the appropriate quantities (i.e., concentrations and flow rates) of alkaline solution 14 to be added to the wash press in this step to achieve a distribution of the desired amount of alkaline material throughout the pulp. In particular, the aqueous sodium hydroxide solution 14 is combined with the pulp in an amount sufficient to provide at least about 0.8 to about 7 percent by weight of sodium hydroxide on pulp based on OD pulp after the consistency is increased by the wash press. As noted above, other sources of alkaline material having equivalent sodium hydroxide content can also be employed, such as oxidized white liquor.

The wash press 13 also removes residual liquid 16, called pressate or wash filtrate, from the pulp. Also, alkaline material which is not retained on the pulp due to less than ideal displacement will be included in pressate 16. This pressate 16 is directed to a holding or seal tank 17, which can be used to achieve smooth, continuous operation of the process by retaining all pressate 16 from wash press 13. At least a portion 18 of pressate 16 is recycled to the dilution tank 10. Upon startup, holding tank 17 is filled with a suitable source of dilution water 11, generally fresh water. During continuous operation of the process, pressate portion 18 is returned to the dilution tank 10 and constitutes substantially all the dilution water. Thus, stream 11 is utilized only upon startup (i.e., before pressate is generated by the wash press 13) or when additional dilution water is needed. Alternatively, a portion 19 of the pressate can be used to wash the pulp upstream of wash press 13 at washer 7 as part of stream 8. Also, as shown, a split shower can be used on washer 7, with part of the wash water provided by stream 8 and part by stream 19. Pressate portion 19 can be discharged to the plant recovery system as necessary to maintain water balance in the dilution tank/wash press circulation loop.

For the situation where significant amounts of alkaline material are introduced into the pressate due to imperfect displacement of the wash water 14 into the pulp, the concentration of the alkaline material in the wash water 14 can be increased to compensate for such imperfect displacement. The recycling of the pressate to the dilution tank raises the concentration of alkaline material in the dilution water, thus enabling the pulp/dilution water stream 12 to have a greater content of alkaline material. This recycling increases alkaline material retention in the pulp to the desired level at the expense of a slight lowering in the degree of washing action and the reduction of carryover of undesired material on the pulp 15 which exits the wash press.

One skilled in the art having the benefit of this disclosure before them can determine by routine experimentation the appropriate alkaline material concentrations for the wash water 14 based on the actual dilution factors and displacement ratios used to operate the wash press 13 to apply the desired amount to the pulp.

In a second embodiment of the invention, which is also shown in FIG. 2, a first portion of the total amount of alkaline material necessary for application to the pulp for the high consistency delignification in the oxygen reactor 21 is added to the wash press 13 in the manner described above.

In U.S. Pat. No. 5,173,153, the content of which is expressly incorporated by reference herein, it was demonstrated that the application of about half of the desired amount of alkaline material to the pulp in a substantially uniform distribution, such as by mixing low consistency pulp with a solution of a alkaline material, followed by applying the remaining half of the amount by spraying onto high consistency pulp enables the pulp to achieve comparable increased delignification selectivities compared to the application of all alkaline material to the low consistency pulp. In addition, the quantity of alkaline material needed to apply the desired amount onto the pulp was reduced compared to the full low consistency application, while the spraying of a portion of the alkaline material onto the high consistency pulp enables that process to provide rapid modification or adjustment of the total amount to be applied to the pulp to compensate for changes in the properties of the pulp or to vary the degree or extent of the oxygen delignification of that pulp.

Figure 3:
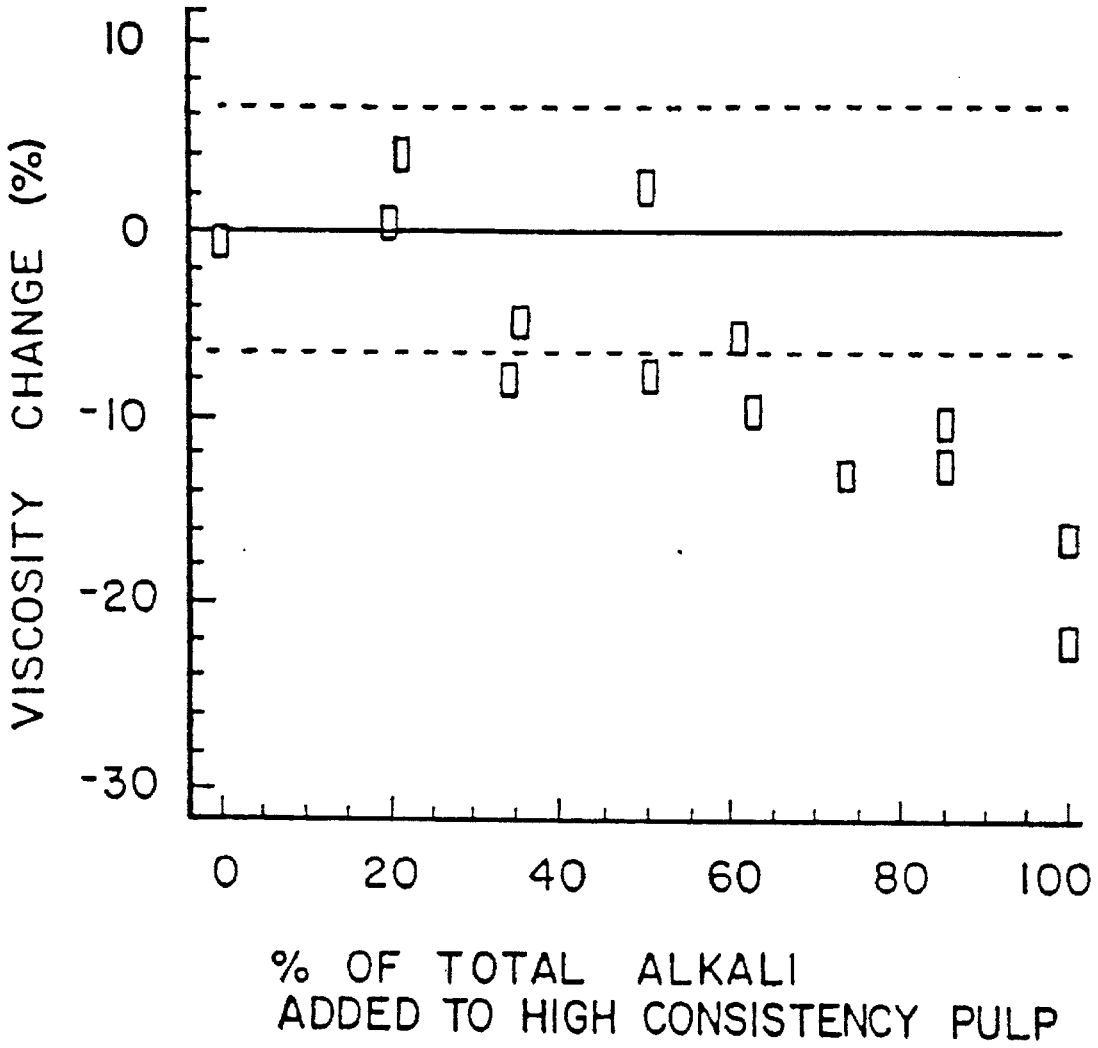
FIG. 3 is a graph showing the relationship between percent viscosity change according to the proportion of alkaline material applied to the pulp at high consistency.

Examples 6 to 9 of that patent application illustrate the benefits obtainable by application of the alkaline material according to the split addition process. FIG. 3 of the present invention illustrates the effect of increasing the percentage of proportion of alkaline material utilized in treating the high consistency pulp. The solid horizontal line proximate to the 0 viscosity change numeral corresponds to the baseline viscosity achieved with all alkaline material applied to low consistency pulp. The two broken horizontal lines on either side of the solid 0 line delineate the boundaries of a typical ±6% deviation in viscosity. As is evident from FIG. 3, as the amount of alkaline material applied onto the high consistency pulp exceeds about 50% of the total applied to the pulp, the viscosity of the delignified pulp drops below the acceptable deviation. The benefits of enhanced delignification selectivity are also reduced for applications of 50% or more of the alkaline material to the high consistency pulp. Therefore, at least about 50% and preferably from about 55 to 90% of the alkaline material should be applied to the low consistency pulp, with the balance applied to the high consistency pulp.

The present invention contemplates similar advantages by applying about half of the total amount of alkaline material during the wash press 13 treatment described above. Thereafter, a second amount of additional alkaline material is applied to the high consistency brownstock 15 exiting the wash press 13 by conventional spray techniques to obtain the desired total amount of alkaline material on the pulp prior to oxygen delignification. This second amount of alkaline material is selected to apply the remaining amount necessary (again, about one-half of the total amount) to achieve the desired extent of delignification in the subsequent oxygen delignification step which is carried out on the alkaline material treated high consistency pulp.

As noted above, the total amount of alkaline material actually applied onto the pulp will generally be between 0.8 and 7 percent by weight based on OD pulp, and preferably between about 1.5 and 4 percent by weight for southern softwood and between about 1 and 3.8 percent by weight for hardwood. In the alternate embodiment of FIG. 2, about half these amounts are preferably applied in each of the low consistency and high consistency treatments. Thus, about 0.5 to 2 percent by weight, preferably about 0.5 to 1.9 percent by weight for hardwood and 0.75 to 2 percent by weight for softwood, is applied onto the pulp during each of the low and high consistency pulp alkaline treatments.

The split addition process of this invention further improves control of the addition of alkaline material to the pulp. The high consistency alkaline treatment step allows rapid modification or adjustment of the total amount of the alkaline material present in or upon the pulp which will enter the oxygen delignification reactor 21. The combination of easy control of both the amount of alkaline material added to the wash water of the press with the amount sprayed onto the high consistency pulp creates an optimum response to changing delignification requirements in that the precise total amount to be applied to the pulp can be easily and rapidly varied to compensate for changes in the properties (i.e., wood type, K No. and viscosity) of the incoming brownstock, or to vary the degree or extent of oxygen delignification for a particular pulp.

The fully alkaline material treated pulp 15 is then forwarded to the oxygen delignification reactor 21 where it is contacted with gaseous oxygen 22 by any of a number of well known methods. Suitable conditions for oxygen delignification according to the present invention comprise introducing gaseous oxygen at about 80 to about 100 psig to the high consistency pulp while maintaining the temperature of the pulp between about 90° and 130° C. The average contact time between the high consistency pulp and the gaseous oxygen ranges from about 15 minutes to about 60 minutes.

After oxygen delignification in reactor 21, the delignified pulp 23 is washed to remove dissolved organics and to produce a high quality, low color pulp. As noted above, the effluent from this washing stage can be recycled for use on washer 7 or for introduction as stream 11 for dilution tank 10. A portion of this stream is preferably utilized as stream 14 after the addition of concentrated sodium hydroxide or oxidized white liquor thereto. The oxygen delignified pulp can be used to form paper products of unbleached brownstock, or can be sent to subsequent bleaching stages to produce a fully bleached product.

Additional advantages of the present invention can be obtained during the subsequent bleaching of the oxygen delignified pulp 23. Such bleaching can be conducted with any of a wide variety of bleaching agents, including ozone, peroxide, chlorine, chlorine dioxide, hypochlorite or the like. When conventional chlorine/chlorine dioxide bleaching processes are used to increase the degree of brightness of the pulps which have been treated with alkaline material as described above, a substantially reduced amount of total active chlorine is used compared to the bleaching of pulps which are oxygen delignified by prior art techniques. The total amount of chlorine-containing chemicals utilized according to the present invention is reduced compared to the amount needed for the same starting pulp which is not treated with alkaline material in a wash press. Similarly, when the chlorine/chlorine dioxide treated pulp is followed by an alkaline extraction stage, substantially reduced amounts of alkaline material are needed in this stage compared to a bleaching process for pulps which have not been uniformly combined with alkaline material at low consistency. The amount of alkaline material utilized in the extraction step would also be reduced for pulp treated with alkaline material at in a wash press as disclosed herein.

In addition to providing cost advantages with respect to the reduced amounts of chemical necessary for such treatments, the process of the present invention also reduces the amounts of environmental pollutants caused by the use of chlorine, since reduced amounts of chlorine are used. Furthermore, due to the lower usage of chemicals in this portion of the system, the amount of contaminants in the waste water from the plant which is to be treated is correspondingly reduced with similar savings in waste water treatment facilities and related costs.

EXAMPLES

EXAMPLE 1

A mathematical model was used to illustrate the process of the present invention on softwood pulp as described in FIG. 2 with the wash press operated at a dilution factor of 0 and a displacement ratio of 0.95. For this embodiment, pressate portion 19 is utilized as wash water 8 on washer 7. The flow rates for the applicable streams would be as follows:

| Process Stream | Flow Rate liquid pulp | | Pulp Consistency | Sodium Hydroxide |
|---|---|---|---|---|
| (FIG. 2) | (gpm) | (t/d) | (%) | (lb/hr) |
| 9 | 504.2 | 580.8 | 18 | 209.5 |
| 12 | 2726.5 | 580.8 | 3.5 | 1533.8 |
| 14 | 247.9 | — | — | 1213.3 |
| 15 | 312.2 | 580.8 | 28 | 1159.8 |
| 16 | 2662.2 | — | — | 1587.3 |
| 19 | 440.0 | — | — | 262.0 |

Thus, the table shows that the pulp exiting the wash press (stream 15) at a flow rate of 580.8 t/d has a consistency of 28% and contains 1159.8 lb/hr of sodium hydroxide. This calculates to an amount of sodium hydroxide applied to the pulp of about 2.4%. If the wash press could be operated at a displacement ratio of 1, then all alkali added to the wash press by stream 14 would be applied to the pulp leaving the press at stream 15. For operation at displacement ratios of less than 1, a portion of the alkaline material added to the wash press by stream 14 will be lost into the pressate.

EXAMPLE 2

Figure 4:
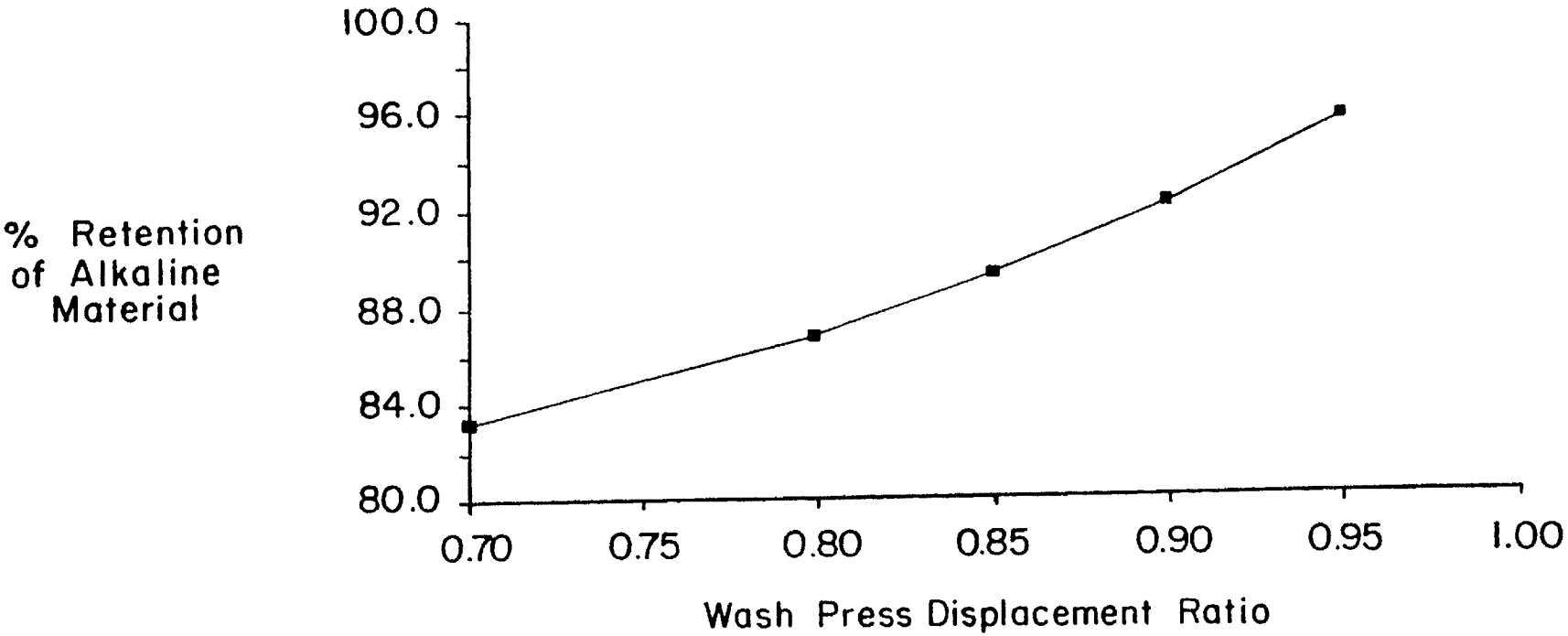
FIG. 4 is a graph showing the percent retention of alkaline material on the pulp for operation of the wash press at various displacement ratios.

To illustrate the transfer of alkaline material to the pulp when operating at different displacement ratios, the graph of FIG. 4 is presented. This illustrates a mathematical model for a wash press that is operated at a dilution factor of 0 and shows how the amount of alkaline material applied to the pulp can vary as the displacement ratio is changed. In this model, the pressate is recycled to both the dilution tank and stream 18 and to brownstock washer 7 as a portion of stream 8. The results thus show the benefit of increased alkaline material retention on the pulp due to recycling.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. A process for obtaining delignification selectivity of pulp during high consistency oxygen delignification, which comprises:

applying a first amount of alkaline material to pulp by treating the pulp in a wash press to dewater, wash and displace the water present with the pulp with a solution of an alkaline material and to increase the consistency of the alkaline material containing pulp to a high consistency of at least about 18% by weight, wherein the alkaline material is added to the wash press and the wash press is operated at a dilution factor of about 0.4 or less and at a displacement ratio of at least about 0.5 and substantially uniformly distributing the alkaline material throughout the pulp while simultaneously washing the pulp;

removing pressate from the wash press;

providing a total amount of alkaline material on the high consistency pulp of at least about 0.8 to 7 percent by weight based on the oven dry weight of the pulp, said total amount including said first amount, wherein the first amount represents at least about 55% of the total amount of alkaline material; and oxygen delignifying the alkaline material containing high consistency pulp to obtain enhanced delignification selectivity of the pulp without a corresponding decrease in pulp viscosity compared to pulp which is not combined with alkaline material in a wash press.

2. The process of claim 1 wherein the pulp is brownstock and which further comprises washing the brownstock in the wash press with a sufficient amount of alkaline material solution so that the first amount applied to the brownstock equals the total amount.

3. The process of claim 1 which further comprises mixing the pulp with dilution water to obtain a low consistency pulp having a consistency of less than about 5 percent by weight and directing the pulp into the wash press to apply the alkaline material thereto.

4. The process of claim 3 wherein the low consistency of the mixed pulp is between about 1 and 4.5 percent by weight and which further comprises recycling at least a portion of the pressate from the wash press for use as the dilution water in the mixing step.

5. The process of claim 4 wherein substantially all dilution water comprises pressate.

6. The process of claim 3 which further comprises holding the pressate which is removed from the wash press and continuously returning a portion of the pressate directly to the pulp/dilution water mixing step.

7. The process of claim 1 which further comprises applying a second amount of alkaline material onto the high consistency pulp wherein the combination of the first and second amounts equals the total amount of alkaline material provided on the high consistency pulp.

8. The process of claim 7 wherein the pulp is unbleached softwood pulp and the total amount of alkaline material applied to the pulp is between about 1.5 and 4 percent by weight, with the first and second amounts each ranging between about 0.75 and 2 percent by weight.

9. The process of claim 7 wherein the pulp is unbleached hardwood pulp and the total amount of alkaline material applied to the pulp is between about 1 and 3.8 percent by weight, with the first and second amounts each ranging between about 0.5 and 1.9 percent by weight.

10. The process of claim 1 wherein the consistency of the pulp is increased to between about 25 and 35 percent by weight prior to oxygen delignification.

11. The process of claim 1 wherein the oxygen delignifying step obtains enhanced delignification selectivity by decreasing the K No. of the high consistency pulp by greater than 50% without significantly damaging the cellulose components of the pulp.

12. The process of claim 11 wherein the K No. is decreased from about 10 to 26 before delignification to about 5 to 10 after delignification.

13. The process of claim 1 wherein the pressate contains alkaline material and which further comprises washing the pulp with at least a portion of the pressate prior to applying alkaline material thereto in the wash press.

14. The process of claim 1 wherein the dilution factor is about 0.25 or less and the displacement ratio is at least about 0.75.

15. A process for obtaining enhanced delignification selectivity of an unbleached pulp during high consistency oxygen delignification, which comprises:

mixing unbleached pulp with dilution water to obtain a low consistency pulp having a consistency between about 1 and 4.5 percent by weight and directing the pulp to a wash press;

applying a first amount of alkaline material to the low consistency pulp by treating the pulp in the wash press to dewater, wash and displace the water present with the pulp with a solution of an alkaline material to ensure that all pulp fibers are exposed to the alkaline material and to increase the consistency of the alkaline material containing pulp to a high consistency of at least about 18% by weight, wherein the alkaline material is added to the wash press and the wash press is operated at a dilution factor at or near zero and a displacement ratio of as close to 1 as possible and substantially uniformly distributing the alkaline material throughout the pulp;

removing pressate from the wash press;

directly recycling at least a portion of the pressate as dilution water for the mixing step;

providing a total amount of alkaline material on the high consistency pulp of at least about 0.8 to 7 percent by weight based on the oven dry weight of the pulp by washing the unbleached pulp in the wash press with a sufficient amount of an alkaline material solution so that the first amount equals the total amount; and oxygen delignifying the alkaline material containing high consistency pulp to obtain enhanced delignification selectivity of the pulp without a corresponding decrease in pulp viscosity compared to pulp which is not combined with alkaline material in a wash press.

16. The process of claim 15 which further comprises holding the pressate which is removed from the wash press and continuously returning a portion of the pressate directly to the pulp/dilution water mixing step.

17. The process of claim 15 wherein the oxygen delignifying step obtains enhance delignification selectivity by decreasing the K No. of the high consistency pulp by greater than about 50% without significantly damaging the cellulose components of the pulp.

18. A process for obtaining enhanced delignification selectivity of an unbleached pulp during high consistency oxygen delignification, which comprises:

mixing unbleached pulp with dilution water to obtain a low consistency pulp having a consistency between about 1 and 4.5 percent by weight and directing the pulp to a wash press;

applying a first amount of alkaline material to the low consistency pulp by treating the pulp in the wash press to dewater, wash and displace the water present with the pulp with a solution of an alkaline material to ensure that all pulp fibers are exposed to the alkaline material and to increase the consistency of the alkaline material containing pulp to a high consistency of at least about 18% by weight, wherein the alkaline material is added to the wash press and the wash press is operated at a dilution factor at or near zero and a displacement ratio of as close to 1 as possible and substantially uniformly distributing the alkaline material throughout the pulp;

removing pressate from the wash press;

directly recycling at least a portion of the pressate as dilution water for the mixing step;

applying a second amount of alkaline material onto the high consistency pulp after it exits the wash press, wherein the combination of the first and second amounts equals a total amount of at least about 0.8 to 7 percent by weight based on the oven dry weight of the pulp of alkaline material on the high consistency pulp, wherein the first amount represents at least about 55% of the total amount of alkaline material; and oxygen delignifying the alkaline material containing high consistency pulp to obtain enhanced delignification selectivity of the pulp without a corresponding decrease in pulp viscosity compared to pulp which is not combined with alkaline material in a wash press.

19. The process of claim 18 wherein the pulp is softwood pulp and the total amount of alkaline material applied to the pulp is between about 1.5 and 4 percent by weight, with the first and second amounts each ranging between about 0.75 and 2 percent by weight.

20. The process of claim 18 wherein the pulp is hardwood pulp and the total amount of alkaline material applied to the pulp is between about 1 and 3.8 percent by weight, with the first and second amounts each ranging between about 0.5 and 1.9 percent by weight.

21. The process of claim 18 wherein the oxygen delignifying step obtains enhance delignification selectivity by decreasing the K No. of the high consistency pulp by greater than about 50% without significantly damaging the cellulose components of the pulp.

* * * * *

UNITED STATES PATENT AND TRADEMARK OFFICE

CERTIFICATE OF CORRECTION

PATENT NO. : 5,525,195

DATED : June 11, 1996

INVENTOR(S) : FRIEND et al.

It is certified that error appears in the above-indentified patent and that said Letters Patent is hereby corrected as shown below:

On the title page, after"[*] Notice: The term of the patent shall not extend beyond the expiration date of Pat. No.", replace "5,217,574" with --5,085,734--.

Signed and Sealed this

Twenty-ninth Day of October 1996

Bruce Lehman

*Attest:*

BRUCE LEHMAN

*Attesting Officer*

*Commissioner of Patents and Trademarks*